US006425404B1

(12) United States Patent
Quevedo

(10) Patent No.: US 6,425,404 B1
(45) Date of Patent: Jul. 30, 2002

(54) HAIR CURLER DEVICE

(76) Inventor: Humberto Quevedo, 323 W. 43rd St., New York, NY (US) 10036

( * ) Notice: Subject to any disclaimer, the term of this patent is extended or adjusted under 35 U.S.C. 154(b) by 0 days.

(21) Appl. No.: 09/826,942

(22) Filed: Apr. 6, 2001

(51) Int. Cl.[7] ..... A45D 6/14; A45D 2/00; A45D 2/18

(52) U.S. Cl. ..... 132/251; 132/246; 132/245

(58) Field of Search ..... 132/251, 245, 132/246, 242, 253, 254, 256, 259, 260, 264, 267

(56) References Cited

U.S. PATENT DOCUMENTS 2,449,301 A * 9/1948 Interrante ..... 132/251
3,037,515 A * 6/1962 Dietze ..... 132/251
3,498,300 A * 3/1970 Lehn ..... 132/251
3,654,937 A * 4/1972 Meeks ..... 132/251
3,805,812 A * 4/1974 Lee ..... 1321/251
4,270,554 A * 6/1981 Lazzaro ..... 132/251
4,378,814 A * 4/1983 Quevedo ..... 132/251

* cited by examiner

*Primary Examiner*—John J. Wilson
*Assistant Examiner*—Robyn Kieu Doan
(74) *Attorney, Agent, or Firm*—Evelyn M. Sommer

(57) ABSTRACT

A hair curler device has a hair roller formed as a longitudinally extending body with a thicker intermediate portion around which a strand of hair may be wrapped and thinner arm portions on opposite sides thereof, and a hair-holding element having a pair of flat extended leg portions lying in a common plane which are joined together at their ends on one longitudinal side. The leg portions are spaced apart from each other by a gap extending to an opening on an opposite longitudinal side. The leg portions have respective non-linear surfaces facing opposite each other across the gap which have complementary shapes so as to define a first distance apart between the surfaces of the leg portions at the opening, a second distance apart at an intermediate position of the leg portions which is narrower than the first distance, and a third distance apart at the longitudinal side where the leg portions are joined which is about equal to the first distance.

4 Claims, 1 Drawing Sheet

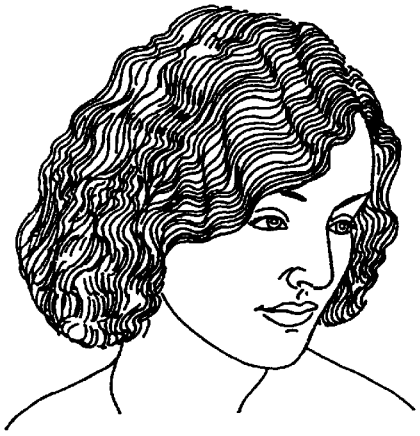
FIG. 1
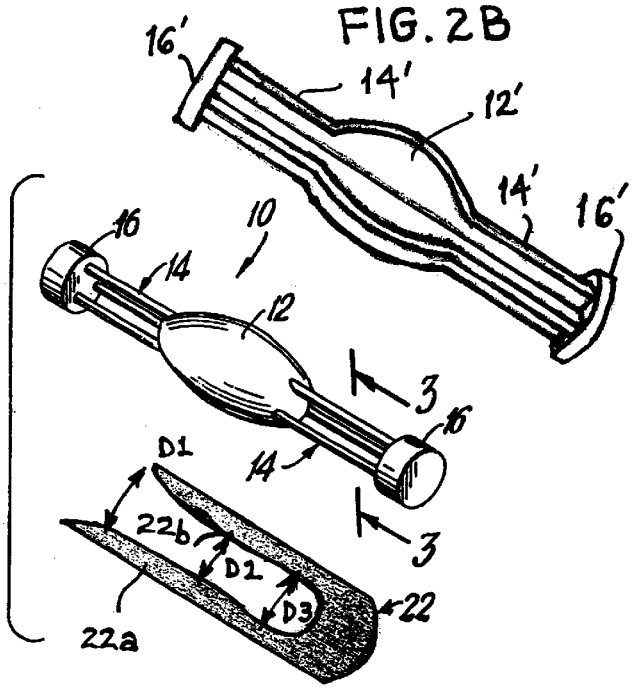
FIG. 2B
FIG. 2A
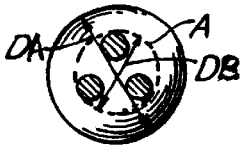
FIG. 3
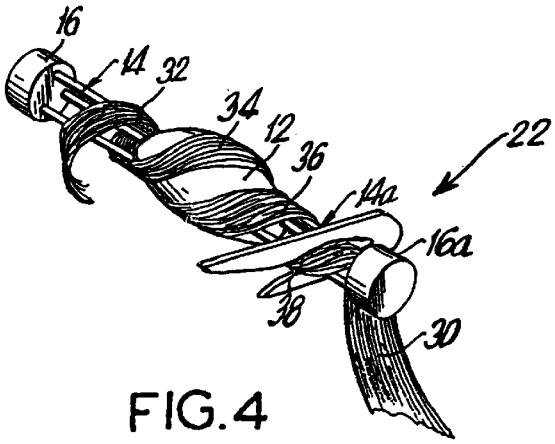
FIG. 4
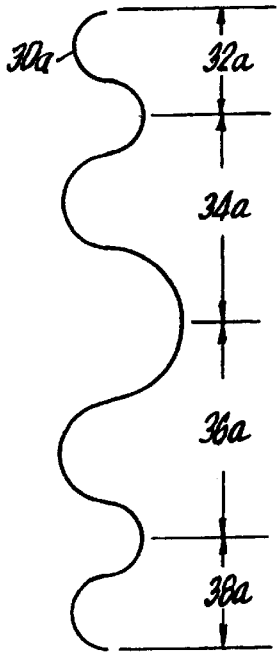
FIG. 5

HAIR CURLER DEVICE

TECHNICAL FIELD

This invention generally relates to an improvement in hair curler devices, and more particularly, to a hair curler device which is easier to manufacture and for the consumer to use.

BACKGROUND OF INVENTION

A related hair curling device was disclosed in U.S. Pat. No. 4,378,814 issued on Apr. 15, 1983 to the same inventor. That device included a longitudinally extending curler body having an irregular cross section and a straight hair-holding pin. In use, a strand of hair is wound around the curler body in a helical manner such that the diameter of successive turns varies. By this arrangement, curls having various curvatures can be formed along the length of a single strand of hair.

In the prior art, a variety of hair rollers have been used for imparting curls to straight strands of hair. More particularly, both professional hair stylists and individuals have used hair rollers to alter the shape and configuration of straight hair to approximate the appearance of natural curls. Most prior art hair rollers have an elongated cylindrical configuration and may be solid or hollow. In use, the hair is separated into groups of strands, with each group of strands being tightly wrapped around the exterior cylindrical surface of the roller. The wrapped strand is then secured in a fixed position relative to the roller by any suitable means such as a bobby pin. When the strand is unwrapped from the roller after a suitable period of time, curls will be formed along the length thereof.

The size and curvature of the curls which are formed correspond directly to the cross sectional diameter of the roller used. More particularly, if larger curls are desired, rollers having a larger diameter are utilized. Similarly, if relatively smaller curls are desired, rollers having a smaller diameter are utilized.

When creating a hair style with rollers, the user generally attempts to approximate the appearance of naturally curly hair. As can be appreciated, naturally curly hair, rather then having curls of uniform size and curvature, has a wide variety of different sized curls. Accordingly, in order to approximate the natural appearance, the user will employ many different sized rollers when styling the hair. More particularly, by wrapping various strands of hair around rollers having different diameters, the resulting hair style can be provided with curls having various curvatures. Unfortunately, the aesthetic appearance achieved by this technique is not entirely satisfactory, since all the curls formed in each wrapped strand have an identical curvature. Different curvatures can only be formed in different strands using different rollers. In contrast, in a naturally curly hair style, the shape and size of the curls is random. Another shortcoming of the prior art technique is the necessity of providing a variety of different diameter rollers. Not only does this required variety increase the cost of a set of curlers, but in addition, the user must carefully select the proper roller for each strand of hair in an attempt to achieve a natural appearance.

While the improvement of U.S. Pat. No. 4,378,814 provided a solution to producing curls having various curvatures in a single strand of hair, it is deemed desirable to modify the hair-holding pin to be easier to manufacture and make it easier for the user to apply to hold hair around the roller.

SUMMARY OF THE INVENTION

In accordance with the present invention, a hair curler device comprises a hair roller having a longitudinally extending body having a non-uniform cross section around which a strand of hair may be wrapped, and a hair-holding element having a pair of flat extended leg portions lying in a common plane which are joined together at ends on one longitudinal side thereof and are spaced apart from each other by a gap extending to an opening on an opposite longitudinal side thereof, wherein said leg portions have respective non-linear surfaces facing opposite each other across the gap which have complementary shapes so as to define a first distance apart between the surfaces of the leg portions at the opening, a second distance apart at an intermediate position of the leg portions which is narrower than the first distance, and a third distance apart at the longitudinal side where the leg portions are joined which is about equal to the first distance.

BRIEF DESCRIPTION OF THE DRAWINGS

FIG. 1 is a perspective view of a person illustrating the naturally curly appearance which can be achieved using the new and improved hair curler device of the subject invention.

FIG. 2A is a perspective view of the improved hair curler device, including one version of a hair roller and pin, and FIG. 2B shows another version of the hair roller.

FIG. 3 is a cross sectional side view, taken along the line 3—3 of the hair roller in FIG. 2A.

FIG. 4 is a perspective view illustrating a strand of hair wrapped around the new and improved hair curling device of the subject invention.

FIG. 5 is a schematic illustration depicting the variable curvature of the strand of hair which can be achieved using the new and improved hair curler device of the subject invention.

DESCRIPTION OF THE PREFERRED EMBODIMENT

In FIG. 1 there is illustrated a person having a naturally curly hair style which can be achieved utilizing the new and improved roller of the subject invention. It is to be noted that individual strands of hair are provided with curls having various curvatures along its length.

In FIG. 2A, the hair curler device includes a hair roller 10 and a hair-holding element 22. The hair roller is formed with a longitudinally extending body having a contoured shape with a thicker intermediate portion 12 and thinner, opposite arm portions 14, and flanges 16 at its opposite ends. The thicker intermediate portion provides a curved contour for shaping hair wrapped over it in a curl, while the thinner arm portions provide the shape between curls. The end flanges 16 inhibit the strand of hair from slipping off the ends. The hair-holding element 22 is designed to fit over the arm portions, as described below. The intermediate portion 12 may be formed as a oblate spheroid shape, and the arms as thin bars in circumferentially spaced configuration. In FIG. 2B, another version of the hair roller is more simply formed with longitudinal fins or ribs in an "X" configuration that have a thicker intermediate portion 12' and thinner arm portions 14' and end flanges 16'. This version may be less costly and easier to fabricate.

The arm portions 14 or 14' of the hair roller body have a circular cross section with a lesser diameter than that of the intermediate portion 12 or 12'. As illustrated in FIG. 3, the diameter DB of the arm portions (to the dashed line A) is smaller than the diameter DA of the intermediate portion of the roller body. The different diameters provide a varying pitch to the hair curls formed by the hair curling device, as explained below.

In accordance with the invention, the improved hair-holding element 22 has a pair of flat extended leg portions 22*a*, 22*b* lying in a common plane which are joined together at their ends on one longitudinal side thereof. The leg portions are spaced apart from each other by a gap extending to an opening on an opposite longitudinal side from the end where the leg portions are joined. The leg portions have respective non-linear surfaces facing opposite each other across the gap which have complementary shapes so as to define a first distance D1 apart between the surfaces of the leg portions at the opening, a second distance D2 apart at an intermediate position of the leg portions which is narrower than the first distance D1, and a third distance D3 apart at the longitudinal side where the leg portions are joined which is about equal to the first distance.

The provision of the spaced apart, axially projecting arms 14 of the hair roller 10 facilitates the maintenance of the hair in a fixed position relative to the roller body after it has been wound around the roller. More particularly, the plurality of rods or bars forming each arm defines a spaced matrix around which the leg portions 22*a*, 22*b* of the hair holding element 22 may be inserted. As shown in FIG. 4, after a strand of hair has been wound around the hair roller 10, the hair-holding element 22 is inserted in a transverse direction with one leg portion on each side of the hair wrapped around the projecting arm. The wider gap distance D1 of the opening between the leg portions facilitates insertion of the element 22 over the projecting arm and hair, while the narrower gap distance D2 provides a detent or blocking effect to prevent the element 22 from becoming dislodged from the hair roller arm after it has been inserted all the way to the wider gap distance D3.

In order to utilize the hair curler device of the invention, a user will first separate their hair into groups or strands 30. One strand 30 may then be wound around the hair roller 10 in a helical manner along the length thereof, as illustrated in FIG. 4. In FIG. 4, there are illustrated four helical turns around the roller body, extending from one flange 16 to the opposed flange 16a. Only four turns have been illustrated for the purposes of clarity, however, it is to be understood that any number of turns may be provided as desired. For example, the number of turns may be increased by spacing the turns closer together or even by overlapping some of the turns. With relatively long hair, it may be desirable after winding towards flange 16*a*, to reverse direction and continue winding back towards flange 16.

Referring to FIG. 4, it will be seen that the first turn 32, adjacent flange 16, is wrapped around first projecting arm 14 having a cross sectional diameter DB, as illustrated in FIG. 3. The second turn 34 passes over one end of the intermediate member 12 and extends towards the center thereof. By this arrangement, the diameter of turn 34 gradually increases to equal the diameter DA of member 12. In contrast, the diameter of third turn 36 gradually decreases as it approaches the arm 14*a* on the opposite side. As can be appreciated, the diameter of fourth turn 38, which is wound around the second set of rods 14*a*, has a diameter DB approximately equal to the first turn 32.

The unique styling effect which can be achieved utilizing the hair curler device on hair is schematically illustrated in FIG. 5. More particularly, and as discussed above, the curvature imparted to the hair by the non-linear shape of the hair roller corresponds to the diameter of the roller. Accordingly, the first turn of a strand 30*a* of hair wound in a manner similar to strand 30 in FIG. 4, will have a relatively small curvature as shown at area 32*a*, illustrated in FIG. 5. The second turn of strand 30*a* will be formed with a gradually increasing curvature as shown at area 34*a* in FIG. 5. Third turn of strand 30*a*, which is wrapped around a portion of hair roller 10 that decreases in diameter, will have a curvature which correspondingly decreases, as illustrated at 36*a*. Finally, the fourth turn, which is wrapped around the opposite arm 14*a*, will have a curvature shown at 38*a* substantially conforming to the curvature 32*a* of the first turn.

In order to create a hair style as illustrated in FIG. 1, a plurality of rollers are utilized. When the hair strands are unwrapped from all the rollers, after a suitable time period, a naturally curly hair style can be achieved. More particularly, instead of providing individual strands with curls having a constant curvature, as achieved by using the prior art rollers, each individual strand is formed with curls having various curvatures. By this arrangement, the naturally curly style can be achieved. In addition, since only one size roller need be used, the requirement of providing a variety of different sized rollers, as in the prior art, is eliminated thereby reducing costs and simplifying their use.

The hair curler device is intended to be used in conjunction with conventional styling techniques. For example, home users typically will initially wash their hair and wrap the strands around the roller while still wet. When the hair is fully dried the strands can be unrolled. This technique tends to produce curls which last for a relatively short duration, on the order of one day. In the alternative, various chemical solutions may be added to the hair to insure that the curling effect, imparted by the roller 10, will be more permanent. In accordance with conventional techniques, a permanent solution can be added either prior to or after the hair has been wound around the roller.

The new hair-holding element has a simple flat shape which allows it to be easily manufactured by cutting or stamping from a flat plastic sheet of stock material. The shape of the leg portions with the wide opening, narrower intermediate position, and wide holding area ensures that the element can be easily inserted by the user over the projecting opposed side arms of the hair roller and will remain securely in place thereon due to the detent or blocking effect of the narrowed gap at the intermediate position. This ensures that the hair roller will not become dislodged and that the wound up hair does not unwind from the roller.

While the present invention has been described with reference to a preferred embodiment, it will be apparent to those skilled in this field that various modifications and changes can be made therein without varying from the scope and spirit of the invention as defined by the appended claims.

I claim:

1. A hair curler device comprising:

a hair roller having a longitudinally extending body having a non-uniform cross section around which a strand of hair may be wrapped, wherein the hair roller is formed with an intermediate member having a thicker diameter in cross-section, and arm portions of thinner diameter extending axially away on opposite sides of the intermediate member, and a hair-holding element having a pair of flat extended leg portions lying in a common plane which are joined together at ends on one longitudinal side thereof and are spaced apart from each other by a gap extending to an opening on an opposite longitudinal side thereof, wherein said leg portions have respective non-linear surfaces facing opposite each other across the gap which have complementary shapes so as to define a first distance apart between the surfaces of the leg portions at the opening which is approximately equal to the thinner diameter of the arm portions of the hair roller such that the hair holding element can be inserted by the opening between the leg portions over an arm portion of the hair roller having hair wrapped thereon, a second distance apart at an intermediate position of the leg portions which is narrower than the first distance, and a third distance apart at the longitudinal side where the leg portions are joined which is about equal to the first distance, said second distance of said leg portions thereby providing a detent or blocking effect for holding onto the arm portion when the hair holding element is fully inserted by the third distance between the leg portions over the arm portion of the hair roller and hair wrapped thereon.

2. A hair curler device according to claim 1, wherein the hair-holding element is formed from a flat plastic sheet.

3. A hair curler device according to claim 1, wherein the arm portions of the hair roller each terminates in a flange at opposed ends thereof provided to inhibit a strand of hair from slipping off the ends of the roller.

4. A hair curler device according to claim 1, suggestion that the first distance between the leg portions is configured to allow insertion over the arm portions of the hair roller, and the second distance provides a detent or blocking effect to hold onto the arm portion when the hair holding element is fully inserted to the third distance over the arm portion.

* * * * *